US005873506A

United States Patent [19]

Golling et al.

[11] Patent Number: 5,873,506

[45] Date of Patent: Feb. 23, 1999

[54] BACKPACK

[75] Inventors: Guido Golling, Groebenzell; Mario Gottmeier; Manuela Lagger, both of Augsburg, all of Germany

[73] Assignee: creative pool trendscouting GmbH, Leitershofen, Germany

[21] Appl. No.: 890,115

[22] Filed: Jul. 9, 1997

[51] Int. Cl.[6] ..... A45F 3/04

[52] U.S. Cl. ..... 224/645; 224/153; 224/579; 224/637; 224/655

[58] Field of Search ..... 224/153, 578, 224/579, 600, 625, 626, 627, 637, 638, 639, 645, 650, 652, 654, 655

[56] References Cited

U.S. PATENT DOCUMENTS

| | | | |
|---|---|---|---|
| 3,938,716 | 2/1976 | Jackson et al | 224/153 |
| 4,059,207 | 11/1977 | Jackson et al. | 224/153 |
| 4,887,751 | 12/1989 | Lehman . | |
| 5,228,609 | 7/1993 | Gregory | 224/625 |
| 5,497,923 | 3/1996 | Pearson et al. | 224/639 |

FOREIGN PATENT DOCUMENTS

| | | | |
|---|---|---|---|
| 167038 | 4/1950 | Austria | 224/209 |
| 881174 | 4/1943 | France | 224/215 |
| 94 14 967.4 | 1/1995 | Germany . | |
| 180216 | 10/1935 | Switzerland | 224/209 |
| 683 741 A5 | 5/1994 | Switzerland | 224/209 |

*Primary Examiner*—Allan N. Shoap
*Assistant Examiner*—Gregory M. Vidovich
*Attorney, Agent, or Firm*—Flynn, Thiel, Boutell & Tanis, P.C.

[57] ABSTRACT

An improved backpack which includes a pack and a single shoulder strap. The single shoulder strap extends from a top corner of the pack to the lower corner on an opposite side from the top corner. The single shoulder strap allows the backpack wearer greater freedom of movement than conventional two shoulder strap backpacks.

13 Claims, 1 Drawing Sheet

BACKPACK

FIELD OF THE INVENTION

The invention relates to a backpack.

BACKGROUND OF THE INVENTION

Conventional backpacks have two shoulder straps extending from the top to the bottom on the relevant side of the backpack. In numerous sport and leisure-time activities there are more or less pronounced movements of the arms at an angle to the direction of locomotion, frequently in the form of a pendulum movement, for example in inline skating or roller skating. The two shoulder straps of known backpacks greatly impair these arm movements.

SUMMARY OF THE INVENTION

The problem addressed by the invention is therefore to provide a backpack which ensures the greatest possible arm movement in such sport and leisure-time activities.

This is obtained according to the invention by providing the backpack with a main shoulder strap extending diagonally from one side at the upper end area of the backpack across the wearer's chest to the other side at the lower end area of the backpack.

Advantageous embodiments of the invention are characterized hereafter.

Due to the main shoulder strap extending over the shoulder and then downward diagonally across the chest in the inventive backpack, the upper area of the backpack is not fixed by a strap on the side where the lower end of the main shoulder strap is fastened, in contrast to known backpacks. This area of the backpack can thus move away from the wearer's back in uncontrolled fashion and thereby disturb the wearer in his movements.

In order to prevent this, the inventive backpack is preferably "cut off" diagonally in this area, so to speak. That is, the upper end area of the backpack slants downward in accordance with the diagonally extending main shoulder strap. The inventive backpack thus at the same time has a "racy" slanted look.

Movement of the arms at an angle to the direction of locomotion is usually accompanied by a lateral rotational movement of the wearer's upper body.

In order to be fixed securely on the back in the case of strong upper-body movements, the inventive backpack is therefore preferably provided with a stabilizing strap which extends from the lower end area on the side of the backpack where the main shoulder strap is fastened with its upper end, diagonally upward to the middle area of the main shoulder strap, and/or with an auxiliary shoulder strap which extends from the upper slanted end area of the backpack to the middle area of the main shoulder strap.

BRIEF DESCRIPTION OF DRAWINGS

In the following descriptions, an embodiment of the inventive backpack will be explained more closely by way of example with reference to the drawings, in which.

DETAILED DESCRIPTION

Figure 1:
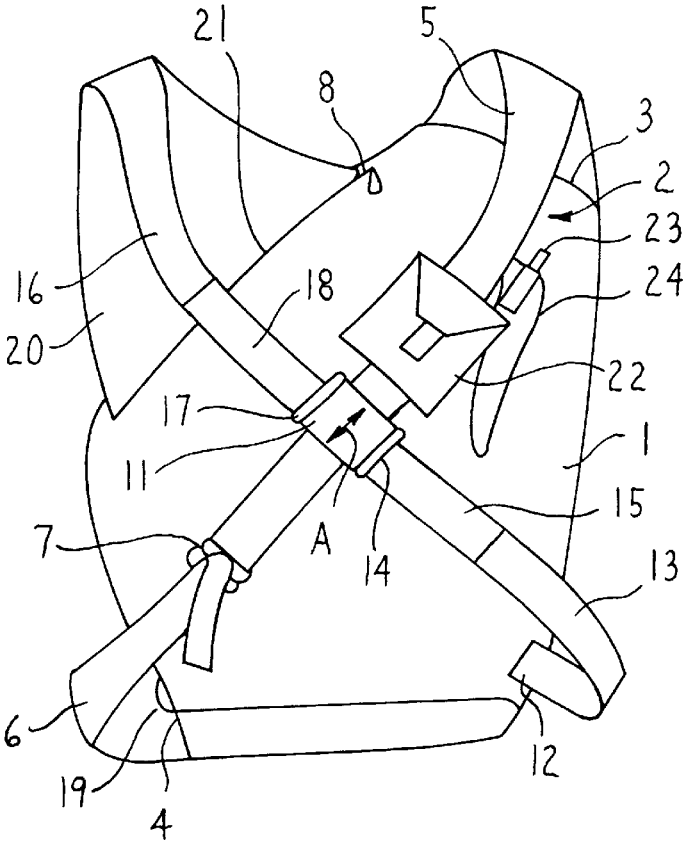
FIGS. 1 and 2 show front and rear views of the backpack, however the auxiliary shoulder strap is stowed in FIG. 2.

Backpack 1 accordingly has main shoulder strap 2 which extends in FIG. 1 from the right upper end area of backpack 1 at 3 to the left side at 4 at the lower end area across the chest of the wearer (not shown).

Main shoulder strap 2 consists of upper portion 5 and lower portion 6 which are interconnected via buckle 7 such that the length of main shoulder strap 2 is adjustable.

In the area of its attachment points 3 and 4 to backpack 1 strap portions 5 and 6 are of broader design. This prevents main shoulder strap 2 from twisting. In addition it stabilizes backpack 1 on the back. The greater contact surface also prevents strap 2 from cutting into the shoulder.

On the left side of backpack 1, i.e. the side where the lower end of main shoulder strap 2 is fastened at 4, backpack 1 has upper end area 8 which slants in the same direction as main shoulder strap 2, i.e. from the right top to the left bottom in FIG. 1, and extends above main shoulder strap 2. Backpack 1 is thus diagonally cut off in this area, so to speak see also FIG. 2).

Figure 2:
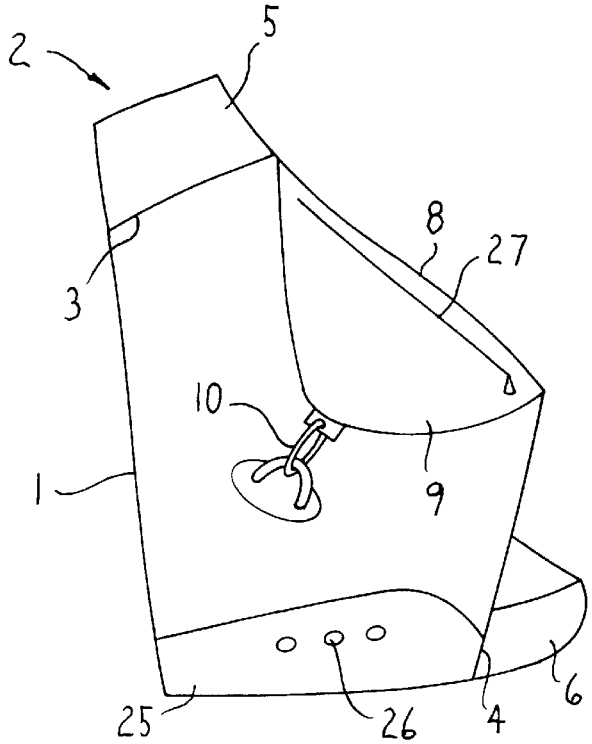

Upper slanted end area 8 has the opening (not shown) in backpack 1, which is covered by cover part 9 fastened to slanted end area 8 and adapted to be fastened to the back of backpack 1 with fastener 10 (FIG. 2).

Main shoulder strap 2 has in its middle area, i.e. in the area of upper portion 5, a plate-shaped slide 11 which is displaceable along main shoulder strap 2 in accordance with double arrow A in FIG. 1.

From the lower end area on the right side of backpack 1 (FIG. 1), i.e. the side where main shoulder strap 2 is fastened with its upper end, stabilizing strap 13 extends from 12 to slide 11 to which it is detachably fastened. For this purpose, the upper end of stabilizing strap 13 is drawn for example through clip or slot 14 on slide 11 and fixed thereto, e.g. by a Velcro (hook and loop fastener) closure 15.

A further stabilizing or auxiliary shoulder strap 16 extends from slanted upper end area 8 of backpack 1 to slide 11 to which it is detachably fastened. For this purpose the lower end of auxiliary shoulder strap 16 is for example, like stabilizing strap 13, drawn through clip or slot 17 on slide 11 and fixed with a Velcro closure 18.

Stabilizing strap 13 can also be used as a hip or belly strap. For this purpose the upper end of stabilizing strap 13, detached from slide 11, can be placed about the belly and fastened to the left side in the lower end area of backpack 1, for example by drawing this end through clip 19 fastened to backpack 1 at this place, and then fixing this end of stabilizing strap 13 with Velcro closure 15.

If stabilizing strap 13 is not required as a hip or belly strap it can be fastened to clip 19, while extending between backpack 1 and the wearer's back.

Auxiliary shoulder strap 16 is fastened with wide portion 20 to slanted upper end area 8 of the backpack. This causes it to lie, like main shoulder strap 2, on the wearer's left shoulder, safe from twisting with a wide contact surface on the wearer's other, i.e. right, shoulder.

The auxiliary shoulder strap can, in its state of nonuse detached from slide 11, be stowed in a pocket extending diagonally from the top to the bottom in upper slanted end area 8 of backpack 1 behind cover part 9, said pocket having opening 21 to be closed for example by a zipper. Portion 20 of auxiliary shoulder strap 16 can be made for example of a netlike material which is not only breathable but can also be stowed with little volume in the pocket in cover part 9.

If backpack 1 has little weight, it generally suffices to wear it only with main shoulder strap 2. In addition stabilizing strap 13 can be used as a belly or hip strap in this case.

If backpack 1 has greater weight and/or the wearer makes strong lateral movements of his upper body, stabilizing strap 13 can be fixed and tightened on slide 11, and/or auxiliary shoulder strap 16 stowed in the pocket in cover part 9 can be taken out and fixed and tightened on slide 11.

Slide 11 is thereby shifted along the middle area of main shoulder strap 2 into the optimal position along double arrow A, depending on whether only one of straps 13, 16 is fixed on slide 11 or both straps 13, 16, as shown in FIG. 1, i.e. if straps 13 and 16 cross main strap 2.

Case 22 can further be fastened to main shoulder strap 2. In addition whistle 23 can be provided in a corresponding receiving means in the upper area of main shoulder strap 2 on backpack 1, being fastened to backpack 1 with cord 24 or the like.

Backpack 1 can further have pocket 25 on its back with rearward openings 26 in which one can put for example a flashing light which shines through openings 26.

In cover part 9 there is a pocket with an opening to be closed by zipper 27 and extending diagonally downward in accordance with upper end area 8, which is accessible from outside.

The inventive backpack is intended in particular for in-line skaters and mountain bikers. However it can be used in general as a sport backpack, in particular for sports involving strong lateral upper-body movements, i.e. along with inline skaters, skateboarders and snakeboarders, roller skaters and ice skaters, for example also for skiers and snowboarders.

The embodiments of the invention in which an exclusive property or privilege is claimed are defined as follows:

1. A backpack, comprising:

a pack enclosing a main pack interior which is upwardly open, the pack having first and second sides, a cover part pivotally connected to said backpack and covering and uncovering said upwardly open pack, an elongate main support strap diagonally extending from one upper end area of the first side to a lower end area of the second side for supporting the pack over one shoulder and crossing a chest of a wearer, a slanted upper area of the pack sidewardly spaced from the one upper end area and slanting in the same direction as the diagonally extending main support strap to the pack second side, a clip longitudinally slidably positioned on the main support strap, an auxiliary support strap cantilevered to the slanted upper area and having a free end secured to the clip in a connected position for extending over the second shoulder of a wearer to support the pack by both the main and auxiliary support straps on both shoulders, and having the free end unconnected to the clip in a detached position to support the pack by the main support strap on the one shoulder, and a pocket positioned in the slanted upper area for stowing the auxiliary support strap in the detached position.

2. The backpack according to claim 1, wherein the opening into the pack is in the slanted upper area adjacent the pocket.

3. The backpack according to claim 1, further comprising a stabilizing strap having an end portion which extends from a first side lower corner of the pack, an opposing end portion of the stabilizing strap being secured to the clip with the auxiliary support strap being in the connected position so that the pack is supported by the main support strap forming a first leg of an X-shaped support strap arrangement, and the auxiliary support strap and stabilizing strap forming a second leg of the X-shaped support strap arrangement.

4. The backpack according to claim 3, wherein the opposing end portion of the stabilizing strap is alternatively secured to a second side lower corner with the auxiliary support strap in the detached position.

5. The backpack according to claim 4, wherein the stabilizing strap is adapted to extend around the waist of a wearer to assist in supporting the pack with the auxiliary support strap in the detached position.

6. The backpack according to claim 1, wherein the clip is positioned intermediate opposing ends of the main support strap.

7. The backpack according to claim 1, wherein the pack has means for holding a flashlight, and means for transmitting light emitted by the flashlight outside said means for holding.

8. The backpack according to claim 1, wherein the pack has a top extending from the first side to the second side, the top consisting of a first part and a second downwardly slanted part including the slanted upper area.

9. A less arm movement restricting backpack, comprising:

a pack having generally upstanding first and second sides each having a length, a top extending between the first and second sides, the top having one upper area adjacent the first side and a second upper area slanting downwardly from the one upper area to the second side wherein said length of said second side has a length which is less than said length of said first side the second upper area providing freedom of movement for a wearer, a main support strap diagonally extending from the one upper area to a second side lower area, the main support strap being worn over a first shoulder and extending across the chest of the wearer to support the pack on the wearer; and an elongate auxiliary support strap connected at one end to the second upper area, the auxiliary support strap having attached and detached positions, the auxiliary support strap in the attached position supportingly extending over a second shoulder and having another end removably fastened to the main support strap so as to support the pack over both shoulders of the wearer, the auxiliary support strap in the detached position having the another end free from attachment to the main support strap and not supportingly extending over the second shoulder so that the pack is supported by the main shoulder strap over the first shoulder.

10. The backpack according to claim 9, wherein an upper edge of the second upper area extends essentially parallel to the main support strap.

11. The backpack according to claim 9, wherein a clip slide is slidingly positioned on the main support strap, the another end of the auxiliary support strap being connected to the clip slide in the attached position.

12. The backpack according to claim 11, wherein a pocket is provided on the pack and stows the auxiliary support strap in the detached position.

13. The backpack according to claim 11, wherein an elongate stabilizing strap has one end secured to a first side lower area and is connectable in first and second positions, the stabilizing strap is connected to the clip slide in the first position, and the stabilizing strap is connected to the second side lower area in the second position so as to extend around a waist of the wearer assisting in the support of the pack.

* * * * *

UNITED STATES PATENT AND TRADEMARK OFFICE

CERTIFICATE OF CORRECTION

PATENT NO. : 5 873 506

DATED : February 23, 1999

INVENTOR(S) : Guido GOLLING et al

It is certified that error appears in the above-indentified patent and that said Letters Patent is hereby corrected as shown below:

Priority information is missing on the face of the patent; insert the following:

---[30] FOREIGN APPLICATION PRIORITY DATA

September 11, 1996 [DE] Germany.....296 15 828.3---

Signed and Sealed this

Sixteenth Day of November, 1999

*Attest:*

*Attesting Officer*

Q. TODD DICKINSON

*Acting Commissioner of Patents and Trademarks*